United States Patent [19]

McDonald

[11] 4,050,511

[45] Sept. 27, 1977

[54] HEAT EXCHANGERS

[75] Inventor: Bertrand N. McDonald, Lynchburg, Va.

[73] Assignee: The Babcock & Wilcox Company, New York, N.Y.

[21] Appl. No.: 554,366

[22] Filed: Mar. 3, 1975

[51] Int. Cl.[2] ..... F28D 7/10

[52] U.S. Cl. ..... 165/162; 122/510

[58] Field of Search ..... 165/162, 3, 144, 145; 122/510, 475

[56] References Cited

U.S. PATENT DOCUMENTS

| | | | |
|---|---|---|---|
| 2,081,043 | 5/1937 | Kuhni | 165/163 X |
| 2,477,950 | 8/1949 | Bailey | 165/162 |
| 2,868,180 | 1/1959 | Thunstrom | 122/510 X |
| 3,687,116 | 8/1972 | Holt | 122/510 |

FOREIGN PATENT DOCUMENTS

| | | | |
|---|---|---|---|
| 74,296 | 11/1960 | France | 122/510 |
| 553,485 | 5/1943 | United Kingdom | 165/162 |

*Primary Examiner*—C. J. Husar
*Assistant Examiner*—Theophil W. Streule, Jr.
*Attorney, Agent, or Firm*—Joseph M. Maguire; John P. Sinnott; Angelo Notaro

[57] ABSTRACT

The tubes of a heat exchanger tube bank have a portion thereof formed in the shape of a helix, of effective radius equal to the tube radius and the space between two adjacent tubes, to tangentially contact the straight sections of the tubes immediately adjacent thereto and thereby provide support, maintain the spacing and account for differential thermal expansion thereof.

4 Claims, 3 Drawing Figures

FIG. 2
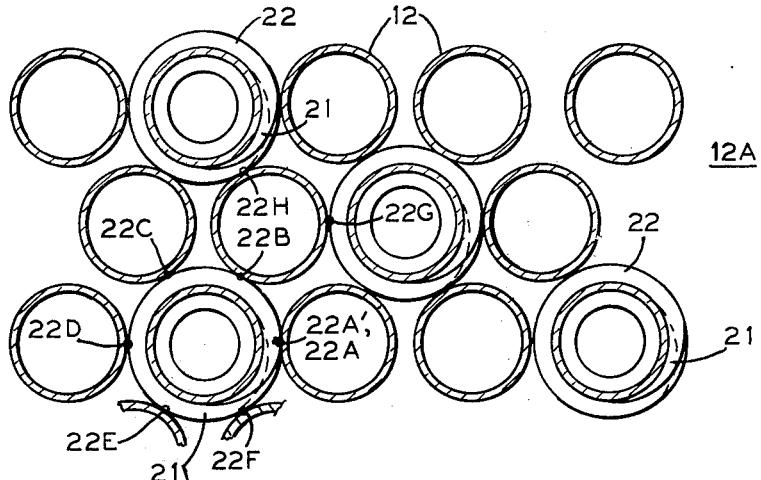
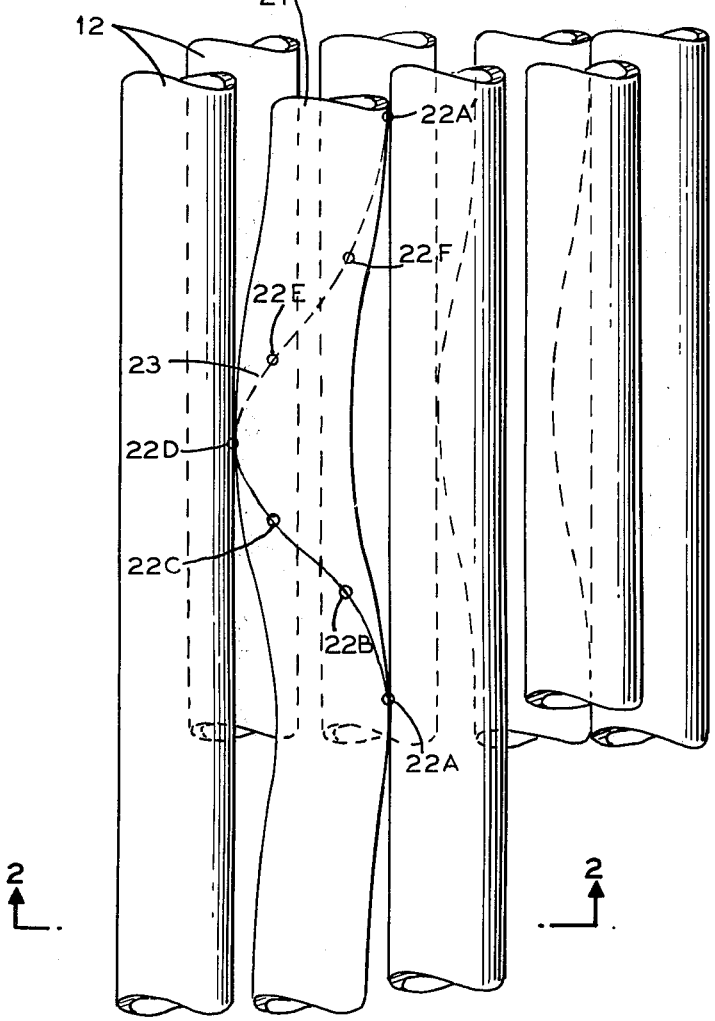
FIG. 3

HEAT EXCHANGERS

BACKGROUND OF THE INVENTION

1. Field of the Invention

This invention relates to heat exchangers and more particularly to an arrangement for supporting a plurality of heat exchanger tubes.

2. Description of the Prior Art

A heat exchanger, according to this description, is a device having an inlet head in fluid communication with an outlet head through a bundle of tubes. Furthermore, the tube bundle is enclosed in a shell that enables one fluid to flow into contact with the tube bundle and to absorb heat from or transfer heat to another fluid flowing through the tubes in the bundle.

Although each of the tubes of the bundle are generally secured in headers, that is, secured to the tube sheet of the header, other support is usually provided to withstand external or internal loads imposed on the heat exchanger and the tube bank. In particular, for a heat exchanger having closely spaced tubes of considerable length, for example, a once through type unit of the size commonly found in a commercial power plant, spacing means as well as support is necessary. This spacing means is provided to prevent tube displacements as a result of thermal expansion or contraction, flow induced vibration or gravity. Tube displacement resulting from, for example, thermal expansion or lack of physical support is undesirable since changes in the flow area about adjacent tubes, causes uneven heat transfer and increased pressure losses within the heat exchanger, and may result in fretting.

In the past, various supporting and spacing methods for heat exchanger tubes have been investigated. One method commonly practiced involves the use of spaced perforated plates commonly called baffle plates placed at intervals along the length of the heat exchanger. The tubes are held in the perforations and the plates are spaced at experimentally and/or theoretically determined intervals to prevent tube vibration. Other known arrangements include: wire wrapping of tubes, interweaving a flexible tubular member between the heat exchanger tubes and forming a heat exchanger tube having a bend therein in one plane to contact an adjacent tube in the same plane through a tie member.

In a once through heat exchanger of the type having tubes of considerable length closely spaced from one another, flow restriction problems are substantially accentuated by only a slight tube displacement. Furthermore, in the once through type of heat exchanger, it is presently necessary to prudently select the tube and shell material and to carefully control their respective operational temperatures to prevent excessive stresses due to different thermal expansion therebetween.

Accordingly, there is a need to provide a means for supporting, spacing and allowing thermal expansion in heat exchanger tubes, especially in commercial power plant heat exchangers of the type having tubes of a considerable length and a small diameter.

SUMMARY OF THE INVENTION

In accordance with the invention, support and spacing between adjacent tubes are provided through a novel tube design. In addition, application of this novel tube design to each tube of the tube bundle alleviates the differential thermal expansion problem discussed above with respect to once through type heat exchangers, and substantially equalizes the pressure loss through each tube.

Specifically, a heat exchanger tube that has these features comprises a section thereof fashioned in the form of a helix, the helix being formed with a helical or effective cylindrical radius larger than the tube radius such that the helical section or loop tangentially contacts the tubes immediately adjacent thereto.

More specifically, in a hexagonally arrayed tube bundle of equally spaced tubes, the helix is formed with an effective radius equal to the tube radius plus the space between two adjacent tubes, whereby the helical section tangentially contacts the six tubes immediately adjacent thereto as the helical section advances angularly about or surrounds the tube's longitudinal axis. Furthermore, the adjacent tubes are also contacted by two other helical sections formed in like manner as above in tubes equally spaced about the adjacent tubes and, therefore, each adjacent tube is supported and spaced by a three point contact with three helical sections. the helically formed tubes being in turn supported and spaced by a six point contact with the six adjacent tubes there about. Moreover, the helical section may angularly repeat about the longitudinal axis, that is, initiate another surrounding loop, and thereby contact again some or all of the adjacent tubes at a longitudinally advanced axial location. Furthermore, the helical section may initially encompass less than a full loop and thereby contact only one or more of the six adjacent tubes, return to its original straight tube axial position and then continue its helical loop structure at a removed longitudinal position along the tube to complete the contact with the remaining adjacent tubes.

Further, thermal expansion of the tubes is accounted for by the curved helical section formed in the tubes. Therefore, in a heat exchanger, such as the above mentioned once through type, in which differential thermal expansion is of prime consideration, the invention may be employed, at different axial locations, in each tube of the tube bundle. In this manner, all of the tubes of the tube bundle are supported and spaced from one another as explained above, and also each tube is provided with loop means for accommodating differential thermal expansion. Moreover, since each tube of the tube bundle is provided with a helical section, the pressure loss through each tube, that is, the fluid running length through the tubes, is substantially the same. Therefore, unbalanced situations due to uneven pressure conditions are alleviated and the thermal load of each tube is likewise substantially equal.

The various features of novelty which characterizes the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

FIG. 2 is an enlarged view, in bottom plan, of a portion of a heat exchanger tube bank that characterizes features of the invention; and FIG. 3 is an enlarged longitudinal view of a plurality of heat exchanger tubes showing features of the invention.

DETAILED DESCRIPTION OF THE PREFERRED EMBODIMENTS OF THE INVENTION

Figure 1:
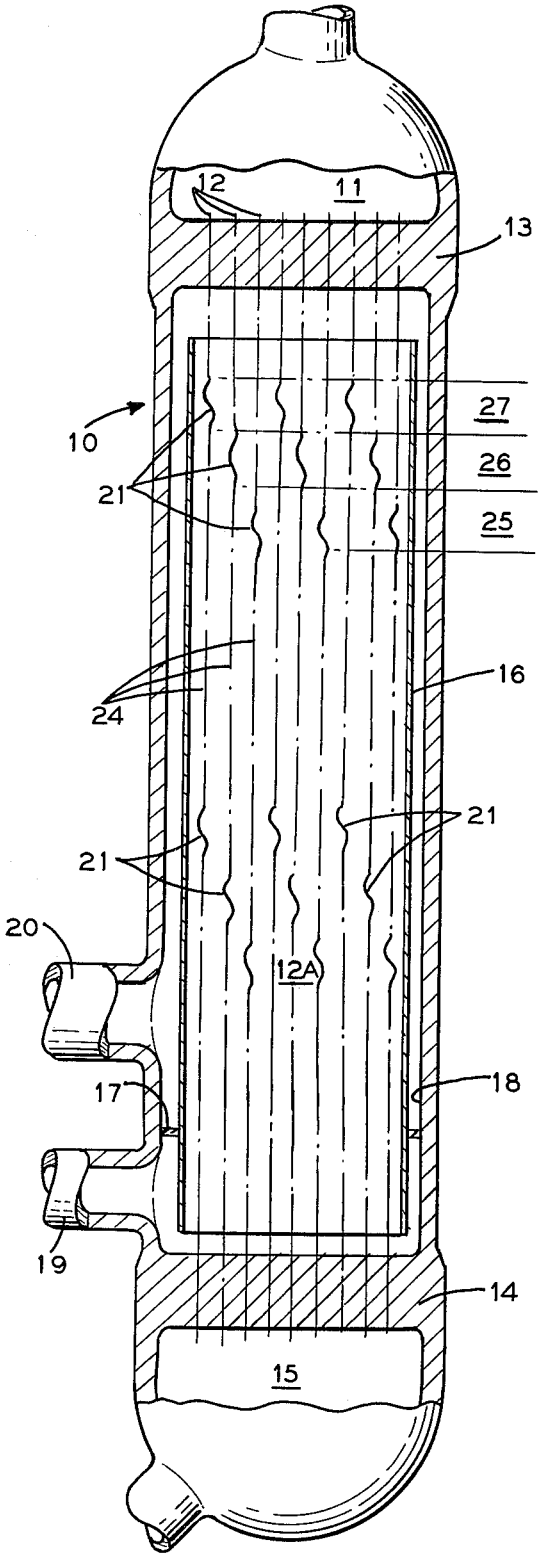
FIG. 1 is a schematic longitudinal view, partly in section, of a once through type heat exchanger embodying features of the invention.

For a more complete appreciation of the invention, attention is invited to the following description of an illustrative embodiment of the invention, as shown in the attached drawings.

In FIG. 1 of the drawings, there is shown a heat exchanger in which a hot primary fluid such as the coolant from a nuclear reactor core (not shown), is passed through a generally upright pressure vessel 10 and therein undergoes physically separated heat exchange with a secondary fluid, such as water, fed into the vessel 10. Primary fluid enters in a plenum chamber 11 at one end of vessel 10 and passes through the tubes 12 of tube bank 12A, (shown in centerline lay out only) received in tubesheets 13 and 14, collects in a plenum chamber 15 at the opposite end of vessel 10 wherefrom it exits for recirculation.

Within vessel 10 there is a shroud 16 surrounding the bundle of tubes 12A and open at both ends. A ring plate 17 connected at its inner edge to shroud 16 and its outer edge to the wall 18 of the vessel 10 serves to separate incoming feedwater introduced through a nozzle 19 from outgoing fluid exiting through another nozzle 20.

In general, a heat exchanger tube bank requires tube support structure or support plates (not shown in FIG. 1) to provide support for and to maintain the spacing between the tubes. To avoid the flow restriction and heat transfer problems generally associated with support structures, the invention proposes that the required support and spacing be provided by tangential tube-to-tube contact between adjacent tubes in the same row and in adjacent rows as shown in FIGS. 2 and 3.

In accordance with this invention, a segment of the tubes is fashioned in the form of a helix 21, FIGS. 2 and 3.

In this connection, it should be noted that a helix is a specific geometric figure, having a precise mathematical equation, and being defined as a three-dimensional curve that lies on a cylinder and cuts the elements thereof at a constant angle. In actual practice, however, it is most likely that the helical section will result in a helix-like figure that only approximates the precise mathematical definition. Therefore, although the shape is not necessarily a helix as precisely defined above, the configuration, for lack of a better term, is denoted a helix herein.

In accordance with this invention, a section of the tubes 12 are formed in the shape of a helix 21 which extends along the tube axis and outwardly therefrom into the space between the helically formed tube and the straight tube sections of the tubes immediately adjacent thereto. Moreover, the outward extension of the helix or the effective circumference 22 allows the helically formed tube to tangentially contact the adjacent tubes. Furthermore, the helices 21 are provided in the tubes 12 such that every straight tube section is tangentially contacted symmetrically about its circumference and thereby is supported and spaced by the helical sections thereabout.

For convenience of description, the segment of tube bank 12A, of FIGS. 2 and 3, is arranged in hexagonal array, and the helices 21 are shown having an effective radius equal to the tube radius plus the space between adjacent tubes. When viewed in the direction of the longitudinal axis (FIG. 2), this symmetrical tube arrangement indicates that the helix 21 has an effective circular circumference 22 which tangentially contacts the six adjacent tubes at points 22A through 22F. It is to be noted that the tubes associated with points 22E and 22F are not shown for the purpose of simplification. These contact points 22A and 22F are shown in FIG. 3 as lying on a helical line 23. The helical line 23 is shown as a broken line from point 22A' to 22D to indicate the contact points along the back side of the helix 21 and is also shown as a continuous solid line along the front of the helix to indicate the contact points thereon.

As shown, one loop of the helix 21 contacts all six adjacent tubes at the points 22A through 22F. However, the helix may proceed in a step wise manner about the longitudinal axis tangentially contacting any number of adjacent tubes, returning to it's "straight" tube position and then resuming its curvilinear path until all the adjacent tubes are contacted. Moreover, the helical section may continue its constant radius spiral and contact again any predetermined number of tubes at a removed longitudinal position as for example 22A'.

Furthermore, in the hexagonal arrayed tube bank, the helical section need be formed in only every third tube in a tube row in order to provide each tube 12 with a three-point support and space maintaining contact, as shown in FIG. 2 as contact points 22B, 22G and 22H. The helically formed tube 21 being supported and maintained by a six-point contact 22A through 22F.

In some heat exchangers, such as the once through steam generators, FIG. 1, commonly found in a nuclear steam generating power plant, not only is tube support and spacing required, but also, it is necessary to account for differential thermal expansion of the tubes. Generally, this differential thermal expansion problem arises due to the extremely long tubes, the different temperature experienced by the tubes and the heat exchanger shell, and/or the different material, that is, the different thermal expansion coefficients of the tubes and the shell. Furthermore, it is also necessary to provide substantially the same pressure drop through each of the tubes and thereby prevent high and low flow situations therethrough and possible hot spots resulting therein.

Therefore, in order to provide support, maintain the spacing, establish essentially an equal pressure drop therethrough or an equal fluid running length and to account for differential thermal expansion of the typically long tubes of a once through steam generator, an embodiment of the invention proposes to provide the helical sections in each tube of the tube bank. In the arrangement shown schematically in FIG. 1, the tubes 12 (shown in centerline lay out only) are each provided with a helical section 21 (shown in centerline lay out) which tangentially contacts the immediately adjacent tubes 12 as described previously. Moreover, the helical sections of each of the immediately adjacent tubes are established at different longitudinal tube positions. In this manner, each tube has a helical section 21 which tangentially contacts a non-helical (straight) tube section 24 of the tubes 12 adjacent thereto, and in turn is contacted by the helical sections 21 of the neighboring adjacent tubes, at its own straight section 24 at some other longitudinal position.

In the embodiment shown in FIG. 1, and for the purpose of illustration, the tube band 12A is characterized by three representative longitudinal sections 25, 26 and 27. It is readily seen from this illustration that a longitudinally staggered arrangement of helical sections for every third tube in a tube row of the tube bank 12A, establishes at each longitudinal section of the row, a tangential contact between the helically formed section of one tube and the "straight" sections of the adjacent tubes. In this way, each tube 12 in the tube bank 12A is supported and spaced from its neighboring tubes, each tube has a helical section to account for differential thermal expansion, and each tube has substantially the same running length or pressure drop therethrough.

Clearly, the longitudinally staggered arrangement of FIG. 1 may be arranged in other patterns and FIG. 1 is not meant to indicate that a specific pattern is required. Furthermore, the helical section may be repeated along the tube length depending upon, among others, the particular heat exchanger size and flow conditions. In addition, although the tubes shown herein are of equal diameter, the tubes with the helical section formed therein are not necessarily so restricted in size. Again, however, different size heat exchanger tubes or the tubes with helical sections would depend to some extent on the specific characteristics, such as size and flow rates, of the particular heat exchanger.

The embodiments of the invention in which an exclusive property or privilege is claimed are defined as follows:

1. A heat exchanger including a plurality of substantially longitudinally aligned and spaced heat exchanger fluid flow tubes wherein at least some of said tubes each comprise a section thereof extending in the longitudinal direction of the tube and bent outwardly from the longitudinal tube axis in an approximately helical shape about the longitudinal axis, said section being in continuous fluid flow relation with the remainder of the tube, and said section having longitudinally successive outwardly extending portions in tangential contact with at least some of the tubes adjacent thereto.

2. A heat exchanger including a plurality of substantially longitudinally aligned and spaced heat exchanger fluid flow tubes arrayed in a hexagonal pattern wherein some of said tubes each comprise a section thereof having approximately a helical axis extending in the longitudinal direction of and about the tube axis and disposed outwardly therefrom, the external wall of said section having successive portions in tangential contact with at least some of the tubes adjacent thereto.

3. A heat exchanger according to claim 2 wherein said external wall of said section contacts all the adjacent tubes thereabout.

4. A heat exchanger according to claim 2 wherein said section has longitudinally successive continuous portions thereof in tangential contact with the same adjacent tube at a plurality of longitudinal positions.

* * * * *